US006085701A

United States Patent [19]

Stauffer et al.

[11] Patent Number: 6,085,701

[45] Date of Patent: Jul. 11, 2000

[54] COIL TUBE HEATER FOR A USED-OIL FIRED FURNACE

[75] Inventors: Norman M. Stauffer, New Holland; Emanuel S. Beiler, Gordonville; Frederick W. Phillips, Leola; Benuel F. Smoker, Narvon; Glenn A. Musser, New Holland, all of Pa.

[73] Assignee: Clean Burn, Inc., Leola, Pa.

[21] Appl. No.: 09/289,732

[22] Filed: Apr. 12, 1999

Related U.S. Application Data

[60] Provisional application No. 60/081,582, Apr. 14, 1998.

[51] Int. Cl.[7] ..... F24H 1/00

[52] U.S. Cl. ..... 122/367.1; 122/367.2; 110/234; 110/238

[58] Field of Search ..... 126/390, 392; 122/248, 276, 367.1, 367.2, 367.3; 110/234, 238

[56] References Cited

U.S. PATENT DOCUMENTS

| | | | |
|---|---|---|---|
| 3,529,579 | 9/1970 | Wanson | 122/248 |
| 3,734,064 | 5/1973 | Cancilla et al. | 122/367.3 |
| 4,453,498 | 6/1984 | Juhász | 122/367.1 |
| 5,494,025 | 2/1996 | Smoker et al. | 126/390 |
| 5,582,137 | 12/1996 | Brady et al. | 110/234 |

FOREIGN PATENT DOCUMENTS

| | | | |
|---|---|---|---|
| 505241 | 8/1954 | Canada | 12/248 |
| 792747 | 4/1958 | United Kingdom | 122/248 |

*Primary Examiner*—Ira S. Lazarus
*Assistant Examiner*—Sara Clarke
*Attorney, Agent, or Firm*—Larry W. Miller

[57] ABSTRACT

A coil tube heater for a multi-oil burner in a used-oil fired furnace utilizing an air to liquid heat exchanger and being fabricated from tubing formed into a tightly coiled cylinder having a plurality of coil loops that are not fixed to any of the adjacent loops to allow for unfettered heat expansion. The coil tube heater is provided with a ceramic sleeve interposed between the burner assembly and the coiled heat exchanger to focus the flame into a tight configuration toward the target positioned at the rear of the combustion chamber. The coil tube heater is provided with a circulation system that has a first circulation loop having a first circulator that moves a liquid transfer medium through the coiled heat exchanger to a buffer tank or directly to the load. A second load loop has a second circulator that draws heated transfer medium from the outlet line leading from the coiled heat exchanger to a load cell before injecting the cooled transfer medium into the inlet line leading back into the coiled heat exchanger.

16 Claims, 12 Drawing Sheets

COIL TUBE HEATER FOR A USED-OIL FIRED FURNACE

CROSS-REFERENCE TO RELATED APPLICATIONS

This application claims domestic priority on U.S. Provisional patent application Ser. No. 60/081,582, filed Apr. 14, 1998, the contents of which are incorporated herein by reference.

BACKGROUND OF THE INVENTION

This invention relates generally to an apparatus for transferring heat from a furnace to a desired location remote from the furnace and, more particularly, to a coil tube heater for use in a used-oil fired furnace to transfer heat from within the furnace to a remote location.

Generally, multi-oil furnaces, sometimes referred to as a used-oil fired furnace because of the primary utilization thereof to burn used oil removed from automobiles and the like as well as standard grades of fuel oils, utilize an air-to-air heat exchanger with a blower than moves ambient air through the furnace structure and/or around the combustion chamber to transfer heat generated within the combustion chamber to a remote location for desired utilization thereof. An efficient air-to-liquid heat exchanger has not been utilized with such used-oil fired furnaces, directly in conjunction with the burner, because of the problems associated with heat expansion, leakage and ash build-up and removal from such furnaces.

Accordingly, it would be desirable to provide a coil tube heater that can be used efficiently with a multi-oil burner to permit the transfer of heat generated by the burner into a liquid medium for transfer to a location remote from the furnace.

SUMMARY OF THE INVENTION

It is an object of this invention to overcome the aforementioned disadvantages of the prior art by providing a coil tube heater or boiler that is operable to transfer heat generated by a used-oil fired furnace to a location remote from the furnace.

It is another object of this invention to provide a coil tube heater that can be effectively used with a multi-oil burner.

It is still another object of this invention to provide an efficient air-to-liquid heat exchanger for use with such used-oil fired furnaces.

It is a feature of this invention that the coil tube heat exchanger or boiler is mounted within the used-oil fired furnace to be used directly in conjunction with the burner.

It is an advantage of this invention that the coil tube heater provides an effective and convenient apparatus for the removal of ash from the coil tube heat exchanger or boiler.

It is another feature of this invention that the coil tube heater is manufactured from coiled tubing that is but welded to minimize leakage problems due to heat expansion.

It is still another feature of this invention that the individual coil loops are not fixed to any adjacent coil loops.

It is still another advantage of this invention that the coil loops are free to expand with usage due to increases in temperature.

It is still another feature of this invention to provide a ceramic sleeve surrounding the burner assembly to direct the flame tightly toward the target provided at the rear of the combustion chamber.

It is still another advantage of this invention that the ceramic sleeve is formed of two semi-circular members to facilitate the manufacture and assemblage thereof.

It is yet another feature of this invention to provide baffles to direct the flow of heated air through the combustion chamber around the coil tube heater to allow for multiple passes of the heated air over the heater coils.

It is still another object of this invention to utilize a liquid transfer medium within the coil tube heater to transfer heat from within the combustion chamber to a location remote from the furnace.

It is yet another object of this invention to provide an effective circulation system for effecting the transfer of heat from within the combustion chamber to a location remote from the furnace.

It is a further feature of this invention to provide the circulation system of the coil tube heater with a buffer tank to serve as a reservoir for the liquid transfer medium.

It is still a further feature of this invention that the circulation system is provided with a first circulation loop having a first circulator moving liquid transfer medium between the coil tube heat exchanger and the buffer tank.

It is still a further feature of this invention that the circulation system is provided with a load loop that has a second circulator that is effective to draw system fluid directly from the coil tube heat exchanger.

It is another advantage of this invention that the buffer tank effectively balances the operation of the two circulators within the circulation system.

It is still a further advantage of this invention that the coil tube heater and circulation system are effectively sized to fit within the same general spatial footprint of a standard used-oil fired furnace.

It is still a further object of this invention to provide a coil tube heater for use with a multi-oil burner which is durable in construction, inexpensive of manufacture, carefree of maintenance, facile in assemblage, and simple and effective in use.

It is yet a further object of this invention to provide a coil tube heater for use with a multi-oil burner in a used-oil fired furnace utilizing an air to liquid heat exchanger and being fabricated from tubing formed into a tightly coiled cylinder having a plurality of coil loops that are not fixed to any of the adjacent loops to allow for unfettered heat expansion. The coil tube heater is provided with a ceramic sleeve interposed between the burner assembly and the coiled heat exchanger to focus the flame into a tight configuration toward the target positioned at the rear of the combustion chamber. The coil tube heater is provided with a circulation system that has a first circulation loop having a first circulator that moves a liquid transfer medium through the coiled heat exchanger to a buffer tank or directly to the load. A second load loop has a second circulator that draws heated transfer medium from the outlet line leading from the coiled heat exchanger to a load cell before injecting the cooled transfer medium into the inlet line leading back into the coiled heat exchanger.

BRIEF DESCRIPTION OF THE DRAWINGS

The advantages of this invention will be apparent upon consideration of the following detailed disclosure of the invention, especially when taken in conjunction with the accompanying drawings wherein.

DESCRIPTION OF THE INVENTIONS

Figure 1:
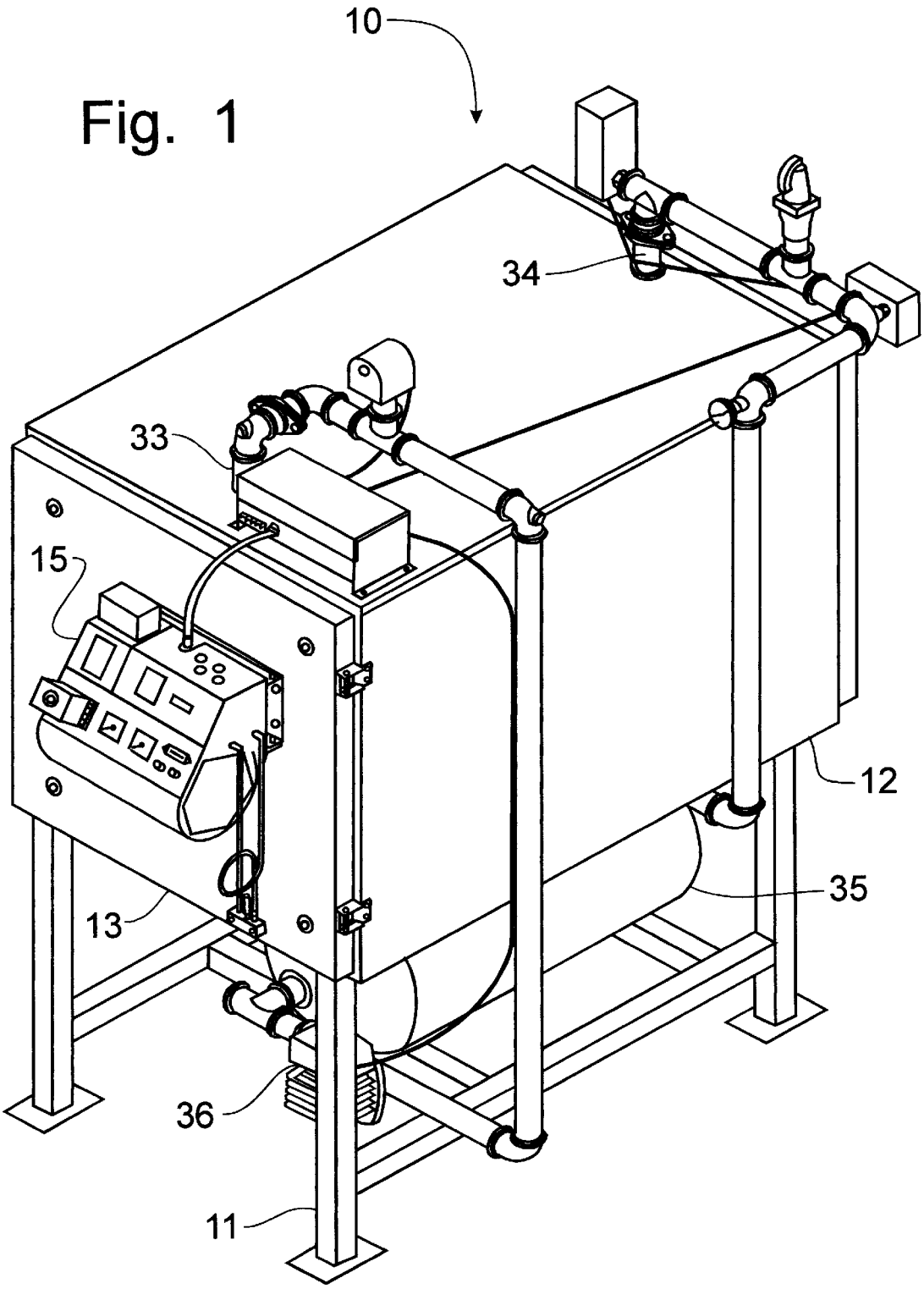
FIG. 1 is an upper, right front perspective view of the used-oil fired furnace incorporating the principals of the instant invention, the buffer tank for the air-to-liquid heat exchanger being positioned on the frame beneath the main furnace structure.
Figure 2:
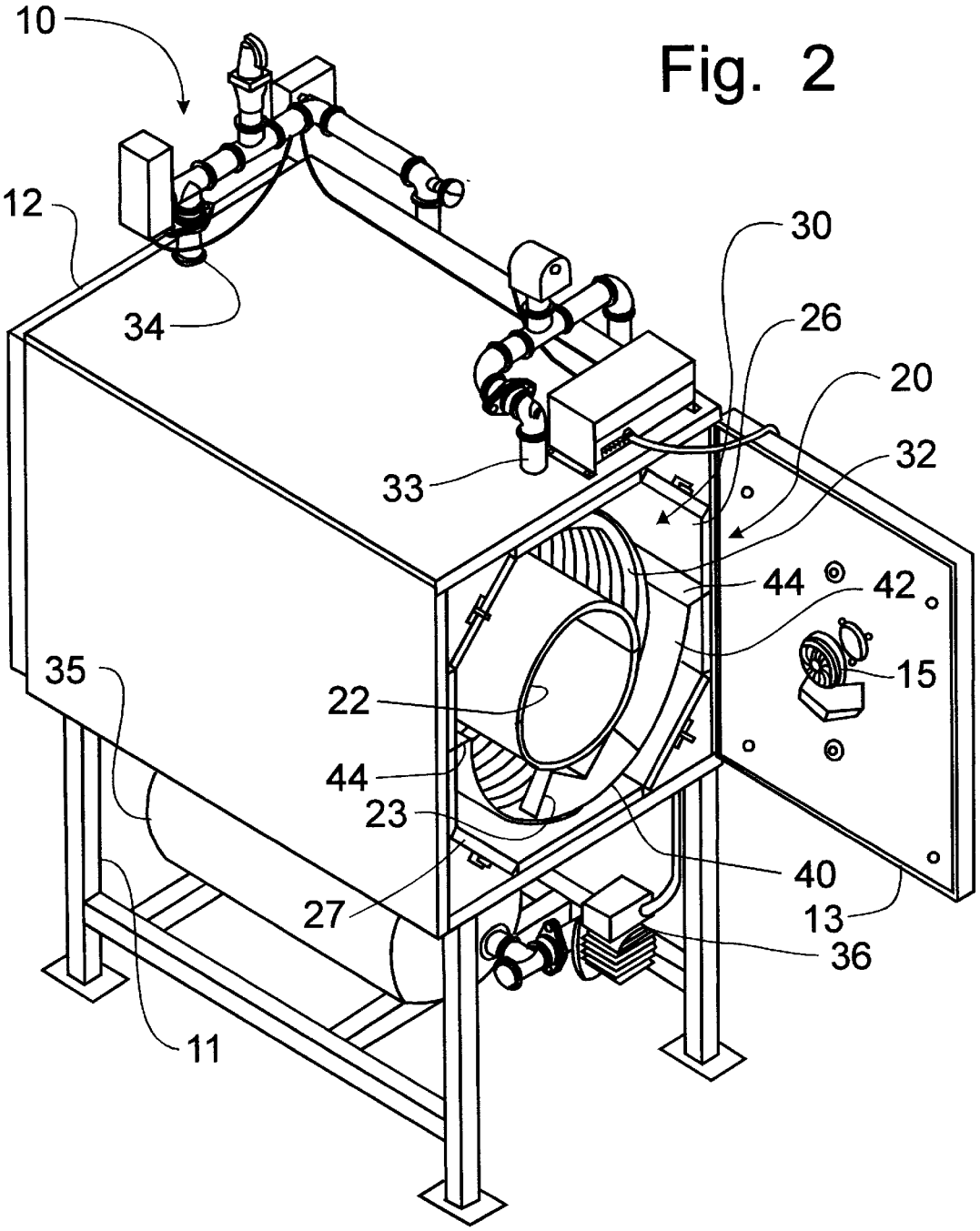
FIG. 2 is an upper, left front perspective view of the used-oil fired furnace depicted in FIG. 1 with the front access door opened to better view the interior combustion chamber.
Figure 4:
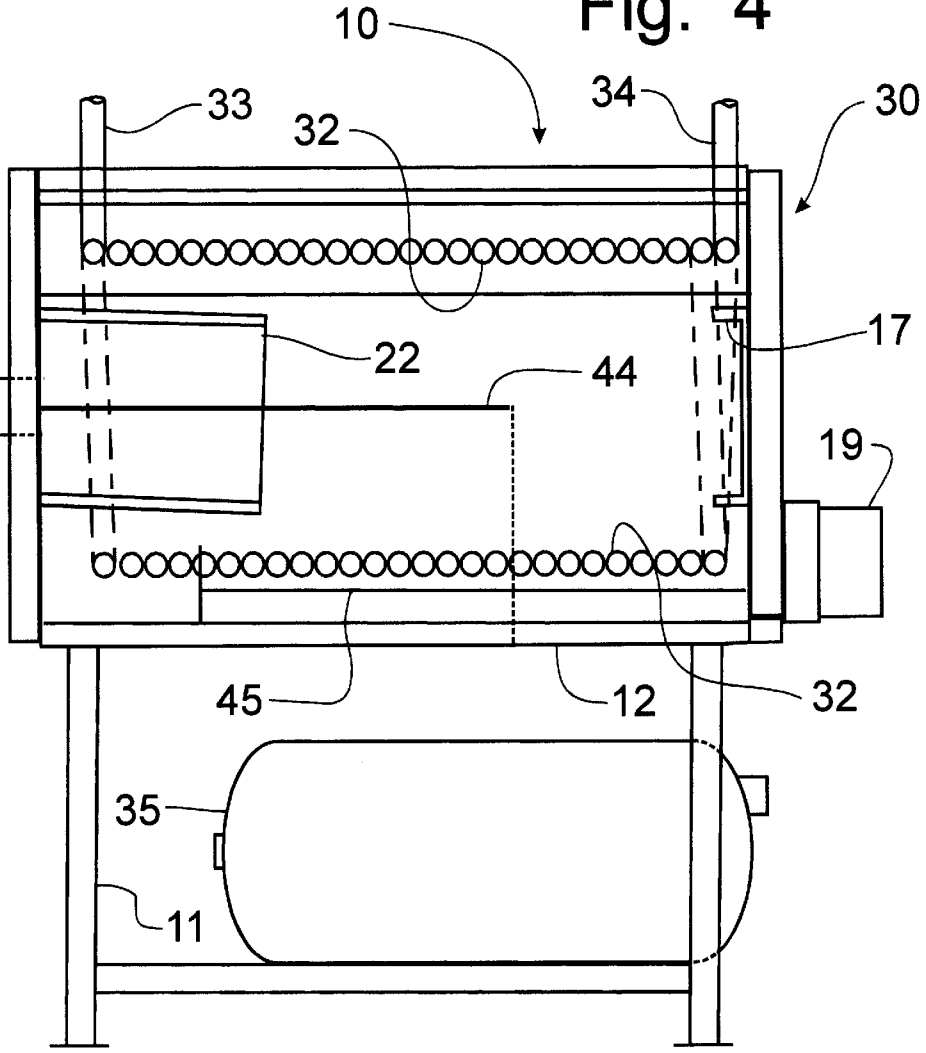
FIG. 4 is a schematic side elevational view of the combustion chamber shown in FIG. 3.
Figure 3:
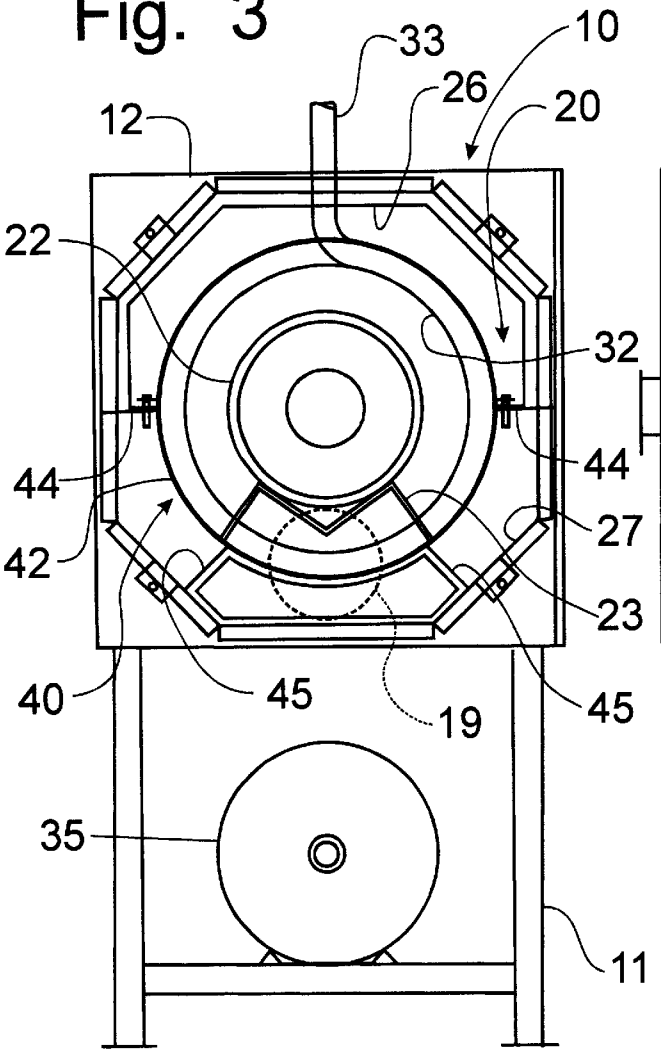
FIG. 3 is a schematic front elevational view of the combustion chamber shown in FIG. 2.
Figure 5:
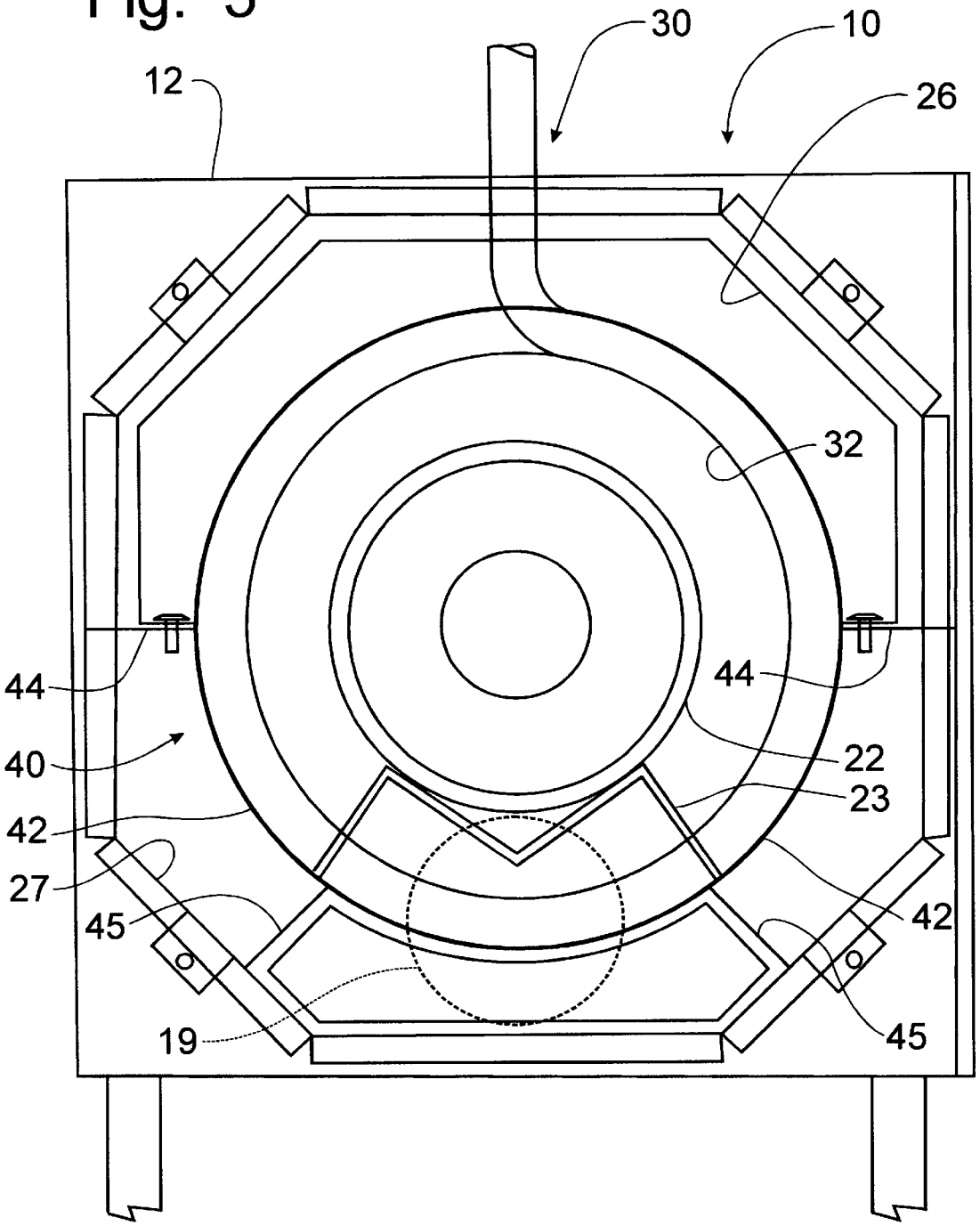
FIG. 5 is an enlarged schematic front elevational view of the combustion chamber similar to that shown in FIG. 3.
Figure 6:
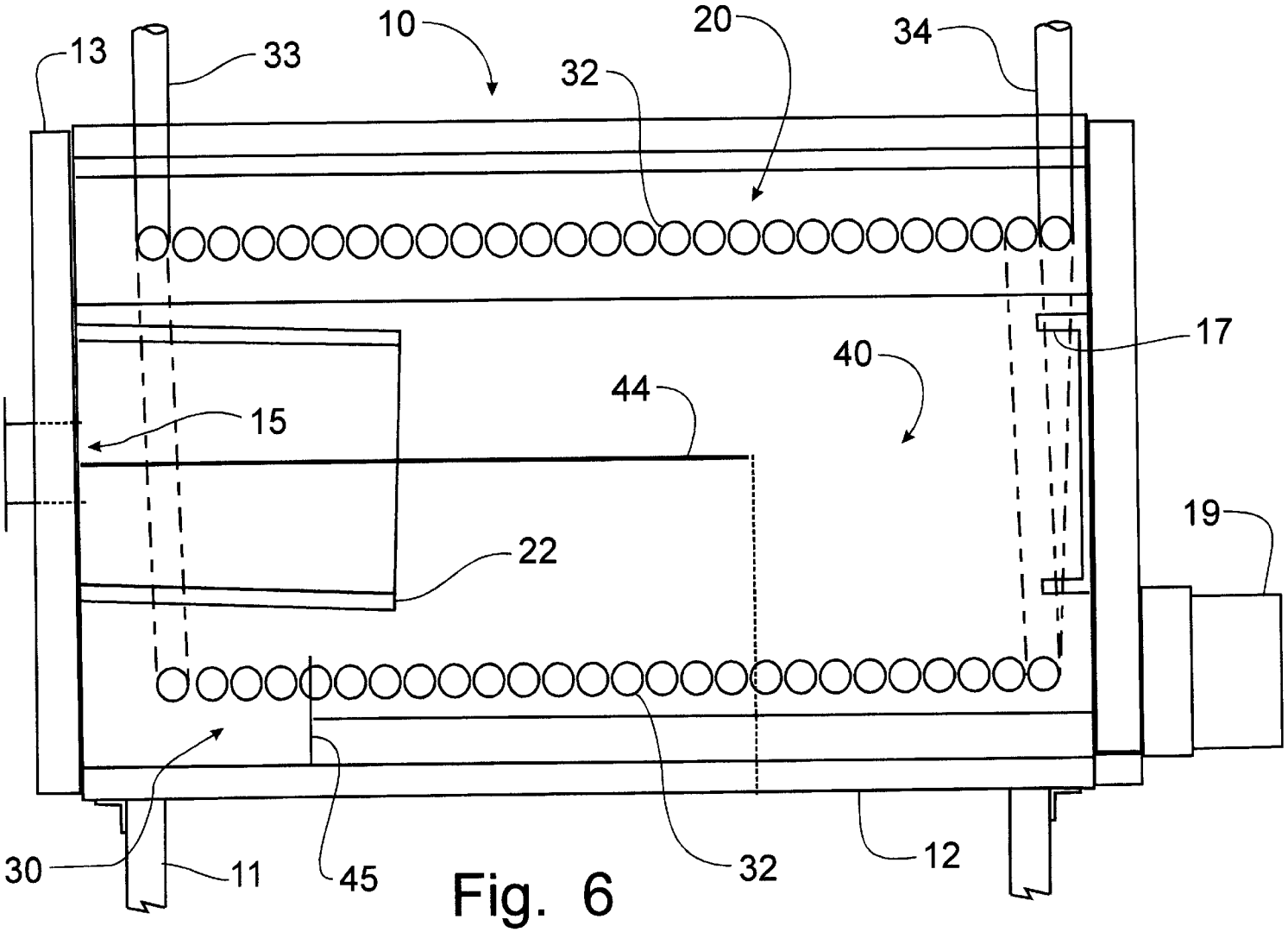
FIG. 6 is an enlarged schematic side elevational view of the combustion chamber similar to that shown in FIG. 5.

Referring first to FIGS. 1–6, a used-oil fired furnace incorporating the principals of the instant invention can best be seen. Any left and right references used herein are determined by standing at the front of the furnace facing the multi-oil burner mounted on the access door. The furnace 10, which can also be referred to as a boiler since the heat generated by the combustion of fuel is used to heat liquid for transfer of the heat remotely of the furnace/boiler, is preferably supported in an elevated position, such as by the frame 11; however, one skilled in the art will readily recognize that the furnace can be mounted in many conventional ways, including being suspended from the ceiling of a room. In the preferred configuration shown in the drawings, the open space defined by the frame 11 beneath the furnace 10 provides a storage space for a buffer tank 35 forming part of the heat transfer apparatus 38 described in greater detail below.

The furnace 10 is an enclosed chamber formed by a cabinet 12 defining the enclosure from all sides. The front access door 13 is hinged at one side to permit an opening thereof to access the internal combustion chamber 20 for cleaning, service and maintenance thereof. In normal operation, the front access door 13 is closed to maintain the enclosure around the combustion chamber 20. On the front access door is mounted a burner assembly 15, such as is shown and described in U.S. Pat. No. 5,409,373, entitled "Burner Housing for a Multi-Oil Furnace", and in U.S. Pat. No. 5,531,212, entitled "Multi-Oil Furnace", the description of each of these two patents being incorporated herein by reference. The burner assembly 15 receives controlled supplies of combustion air and oil from respective sources, as described in detail in the aforementioned U.S. Pat. Nos. 5,409,373 and 5,531,212, to create a flame to be directed toward a ceramic target 17 mounted on the back wall of the cabinet 12.

A ceramic sleeve 22 surrounds the burner assembly 15 and is positioned such that the front end thereof is adjacent the front access door 13. The ceramic sleeve 22 is preferably formed, for purposes of ease of manufacture, of two semi-circular members forming the upper and lower halves of the sleeve 22. In the alternative, the ceramic sleeve 22 could be formed as a one piece cylinder. The ceramic sleeve 22 terminates approximately a quarter of the distance toward the ceramic target 17 and serves to direct the flame created by the burner assembly 15 tightly toward the ceramic target 17. The lower half of the sleeve 22 is supported on a formed support member 23 that rests on the interior of the flow divider support member 42 and on the interior of the coil tube heater 30 to position the sleeve 22 centrally within the coil tube heater 30.

A central distinguishing feature of the combustion chamber 20 is the coil tube heater 30, which is preferably formed from a single length of tubing into a tightly coiled cylinder 32. In practice, the cylinder 32 is more practically constructed from a series of twenty foot lengths of tubing that are butt-welded to form the requisite length of tubing for manufacture of the coil tube heater 30. Preferably, a total of 160 feet of tubing is required for manufacture of the cylinder 32. None of the individual coils of the cylinder 32 are fixed to any adjacent coils so that expansion due to the absorption of heat will not unduly stress the cylinder 32 and provide a source for developing leaks. As a result, the expansion of the cylinder 32 is fairly uniform and results in maintaining the general shape of the cylinder 32 when in use.

Figure 11:
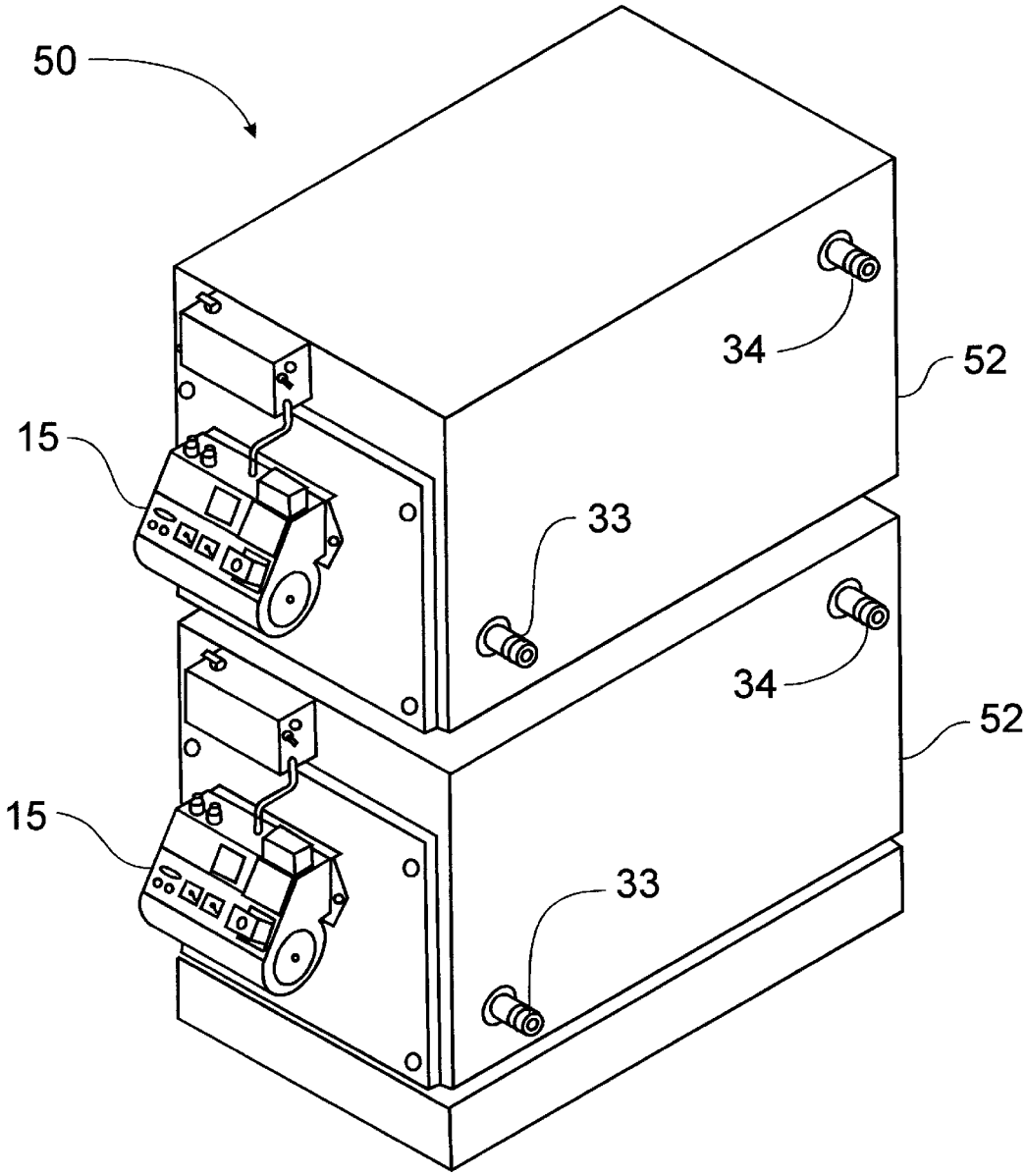
FIG. 11 is an upper, right front perspective view of an alternative configuration for the used-oil fired furnace incorporating the principals of the instant invention, wherein dual furnaces with coil tube heaters are arranged in a vertically stacked orientation.
Figures 12, 13:
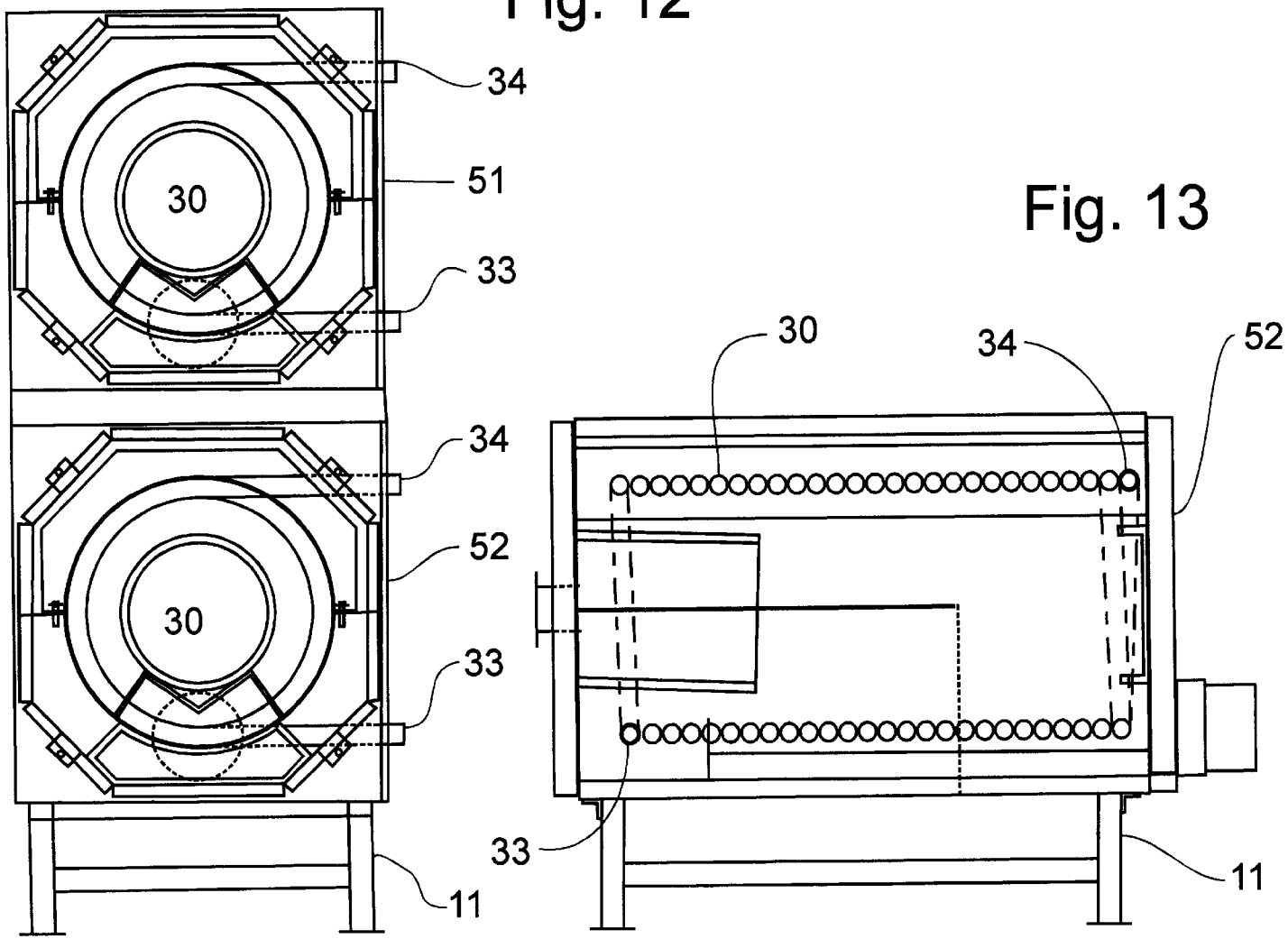
FIG. 12 is a partial schematic front elevational view of the used-oil fired furnace configuration shown in FIG. 11.
FIG. 13 is a partial schematic side elevational view of the used-oil fired furnace configuration shown in FIG. 11.

The cylinder 32 terminates in an inlet pipe 33 in the front of the cylinder 32 and an outlet pipe 34 at the rear of the cylinder 32, both of which project upwardly through the top of the cabinet 12 and the internal insulated top wall 26 of the combustion chamber 20 and are sealed against both the top wall 26 of the combustion chamber 20 and the top of the cabinet 12 to prevent the leakage of exhaust gases from the combustion chamber 20. One skilled in the art will readily realize that the inlet and outlet pipes 33, 34 could also be arranged to project through one of the side walls of the furnace 10, such as would be necessary to permit a vertical stacking of multiple furnace structures, such as depicted in FIG. 11. Both the inlet and outlet pipes 33, 34 are preferably butt-welded to external plumbing forming part of the coil tube heater 30, as described in greater detail below.

To allow the exhaust gases to have multiple passes along the coil tube cylinder 32, the combustion chamber 20 is divided into a convoluted flow path by a central baffled flow divider 40 formed with a central, semi-circular support member 42 upon which rests the coil tube cylinder 32 for support thereof above the bottom of the combustion chamber 20. The outer perimeter of the combustion chamber 20 is defined by a insulated top wall portion 26 and an insulated bottom wall portion 27, both of which are formed in a generally semi-circular orientation to define an octagonal combustion chamber 20 within the cabinet 12.

The baffled flow divider 40 has opposing flanges 44 that engage the junction between the top wall and bottom wall portions 26, 27 of the combustion chamber 20 to vertically divide the forward portion of the combustion chamber 20; however the flanges 44 terminate approximately midway along the length of the cylinder 32 so that the upper and lower portions of the rearward part of the combustion chamber 20 is in open communication. The flow divider 40 is also provided with support legs 45 that extend outwardly from the central semi-circular support member 42 at approximately 45 degrees from vertical to engage the corresponding oblique side walls of the octagonally shaped combustion chamber 20, thereby supporting the flow divider 40, the coil tube cylinder 32, the support member 23 and the ceramic sleeve 22 above the bottom of the cabinet 12.

The support legs 45 extend forwardly from the rear of the cabinet 12 to terminate beneath the semi-circular support member 42 in spaced relationship to the front access door 13. The support legs 45 divide the rearward portion of the combustion chamber into two flow paths, one of which passes between the two support legs 45 to be in communication with the discharge opening 19 from the cabinet 12; however, the termination of the support legs 45 before reaching the front access door 13 allows the lower, forward portion of the combustion chamber 20 to be in open communication for the passage of exhaust gases.

Figure 8:
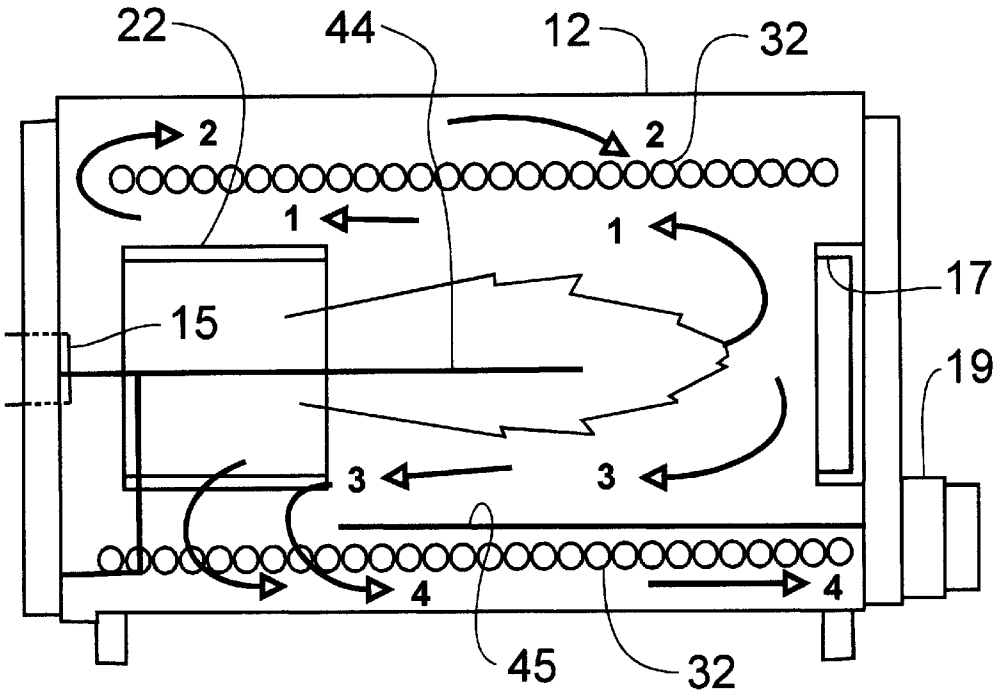
FIG. 8 is a schematic side elevational diagram depicting the flow path of exhaust gases from the combustion chamber to be discharged from the furnace structure.
Figure 7:
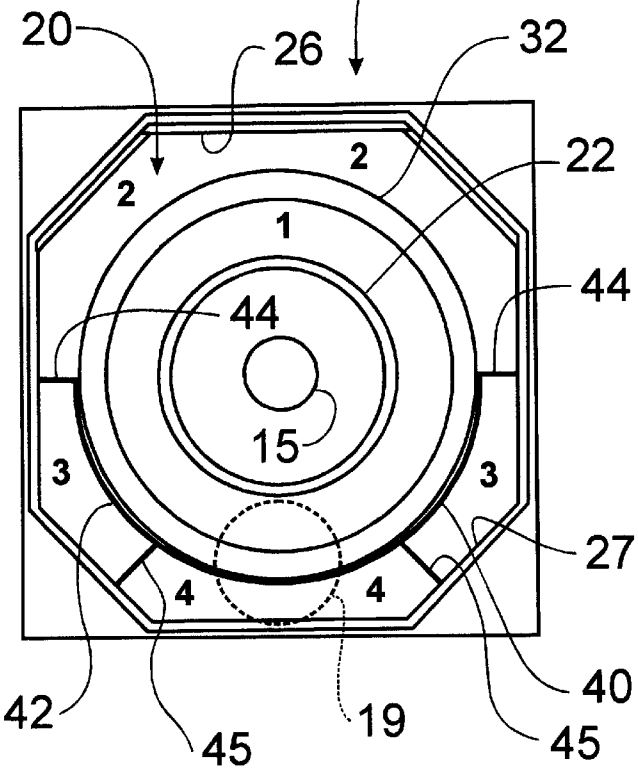
FIG. 7 is a schematic front elevational diagram depicting the flow path of exhaust gases from the combustion chamber to be discharged from the furnace.
Figure 9:
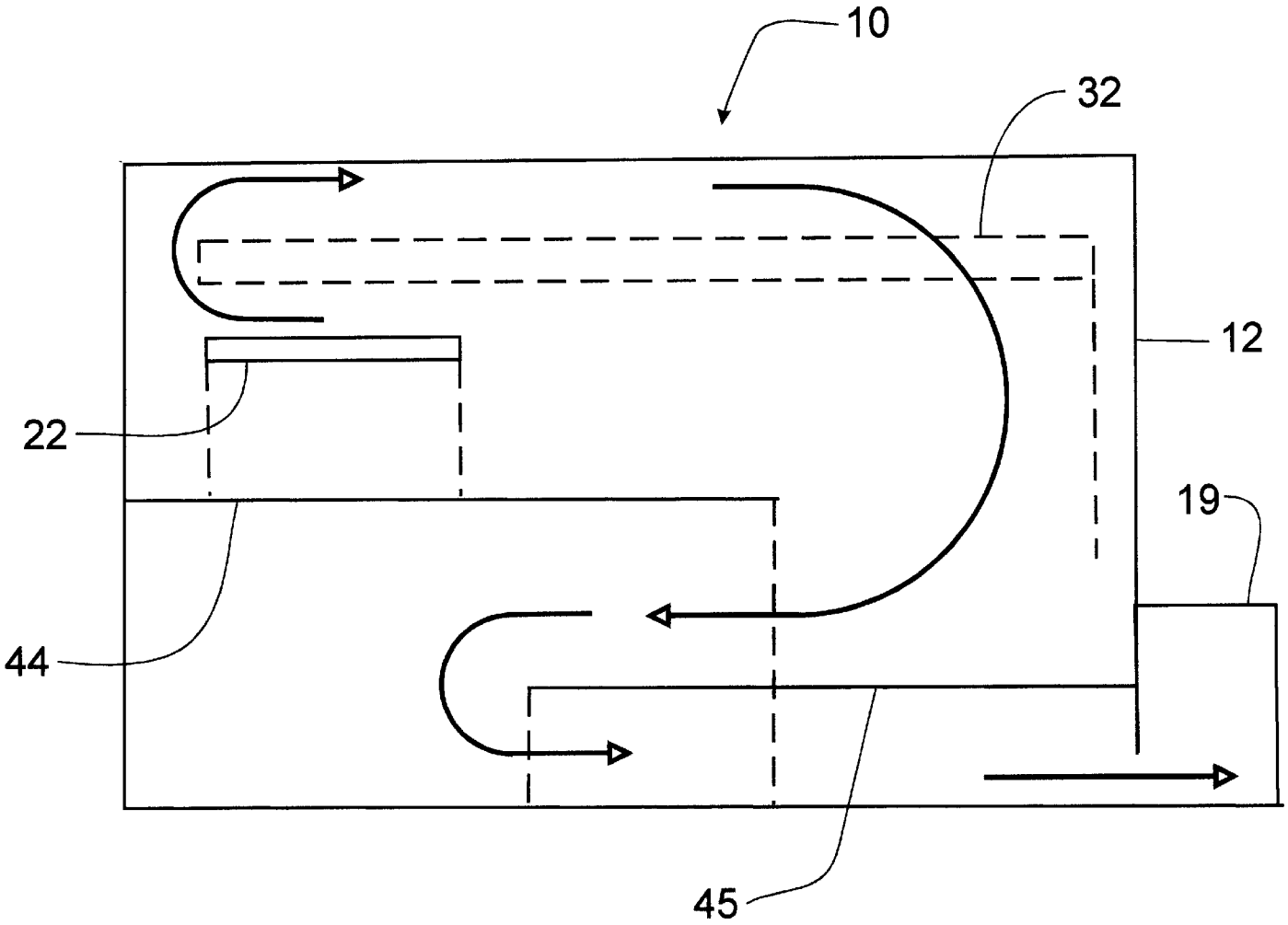
FIG. 9 is a schematic cross sectional diagram depicting the flow path of exhaust gases from the combustion chamber to be discharged from the furnace.
Figure 10:
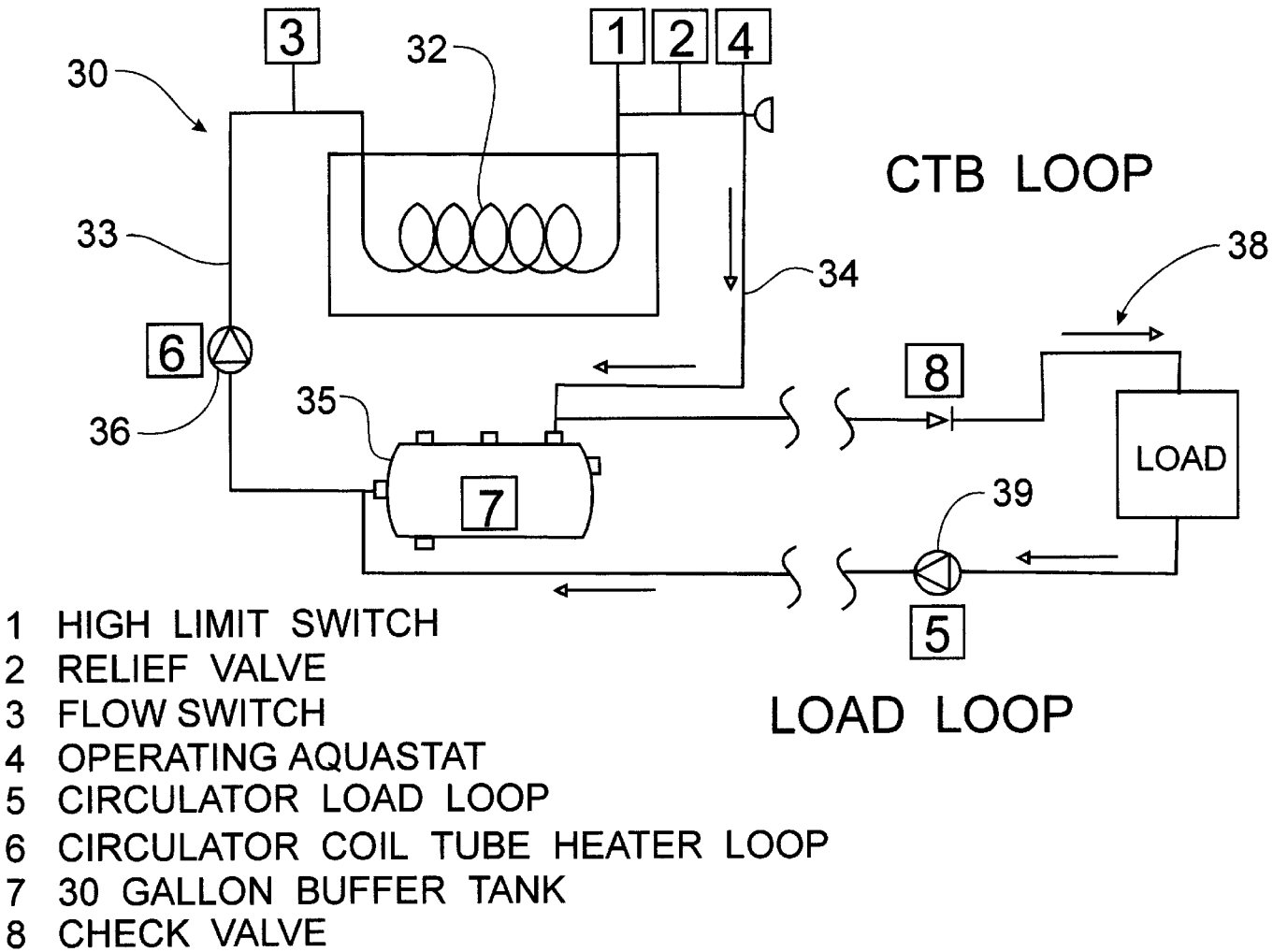
FIG. 10 is a water flow diagram depicting the flow of fluid through the coil tube heater to transfer heat from the combustion chamber to a remote location.

Looking now at FIGS. 7–9, the flow path for the exhaust gases can be seen. After striking the ceramic target 17 mounted at the rear of the combustion chamber 20, the exhaust gases are captured within the tightly coiled cylinder 32 and are forced to double back toward the front of the combustion chamber 20 along the internal surface of the coil tube cylinder 32 in the area marked as 1 on FIG. 7. This passage of the exhaust gases, doubling back on itself, helps to control the flame created by the burner assembly 15 and keeps the flame in a tight configuration directed at the ceramic target 17. Furthermore, the doubling back of the exhaust gases helps to form an envelope of hot gases between the interior surface of the cylinder 32 and the flame created by the burner assembly 15 to prevent the flame from being chilled from the lower temperature differential of the coil tube heater 30.

The coil tube cylinder 32 terminates in a spaced relationship to the front access door 13, while the flow divider 40 contacts the front access door 13, requiring the exhaust gases to travel upwardly around the forward end of the coil tube cylinder 32 and then rearwardly along the exterior surface of the coil tube cylinder 32, providing a second pass along the surface of the cylinder 32, in the area marked as 2 in FIG. 7, for the absorption of heat thereby. The exhaust gases, after reaching the rearward portion of the combustion chamber 20 are then forced downwardly along the exterior surface of the coil tube cylinder 32 and forwardly between the flanges 44 and the support legs 45, in the area marked as 3 on FIG. 7, providing a third pass of the exhaust gases along the coil tube cylinder 32, although part of this third pass has the semi-circular support member 42 positioned between the exhaust gases and the cylinder 32.

Since the support legs 45 terminate at a spaced relationship to the front access door 13, the exhaust gases can then return in a rearward direction between the support legs 45 in the area marked as 4 on FIG. 7 to reach the discharge opening 19 at the rear of the cabinet 12, thereby providing yet a fourth pass of the exhaust gases along the coil tube cylinder 32, although the support member 42 in oriented between the exhaust gases and the cylinder 32. Since the support member 42 is formed from sheet metal, the transfer of heat from the exhaust gases to the coil tube cylinder 32 in either the third or fourth passes is substantially unimpeded.

Referring now to FIGS. 1–4 and 10, it can be seen that the coil tube heater 30 serves as a heat exchanger 38 absorbing heat from the flame and the exhaust gases to permit the heat to be transported to a remote location. The transfer medium within the coil tube heater 30 is intended to be water, which satisfies concerns relating to leaks within the heat exchanger 38; however, one skilled in the art will recognize that other fluids, such as a glycol solution, etc., would also be operable. The specific use of the coil tube heater 30 can depend on the tubing materials from which the coil tube heater 30 is constructed. For example, manufacturing the coil tube heater 30 from standard steel will require that the liquid transfer medium be retained within a closed loop system as the introduction of fresh water, for example, will result in the release of oxygen from the heating of the transfer medium and an oxidation of the tubing. On the other hand, manufacturing the coil tube heater 30 from stainless steel would enable the coil tube heater 30 to be used as a water heater with the transfer medium being water that is consumed as it is heated with fresh supplies replacing the consumed water.

The coil tube heater 30 includes a circulator 36 that forces the water within the system through the coil tube cylinder 32 and into a buffer tank 35, serving as a reservoir from which the circulator 36 can draw water for circulation. Circuit controls include a high limit switch that senses an overheating of the system fluid and will then effect a shut down of the furnace; a relief valve to vent pressure created by any overheated system water; and a flow meter and an operating aquastat to maintain system integrity and control the firing of the burner assembly 15 when heat is demanded, as described in greater detail below.

The load loop of the heat exchanger 38 also includes a circulator 39 to power the transfer of heated fluid from the coil tube heater 30 to a remote location at which the heat can be extracted from the system fluid, such as a radiator or a floor heater for heating a room. Preferably, the load loop will draw system fluid directly from the outlet line 34 between the coil tube cylinder 32 and the buffer tank 35 so that the load loop draws the hottest system fluid available for transport to the remote location. The return of fluid in the load loop from the remote location is preferably plumbed into the inlet line 33 between the buffer tank 35 and the cylinder 32.

Accordingly, the operation of the two circulators 36, 39 must be properly balanced so that the load loop circulator 39 cannot overpower the coil tube heater circulator 36; however, in the event the load loop circulator 39 does overpower the circulator 36, the excess flow will pass into the buffer tank 35 through the outlet side and be drawn back into the load loop from the inlet side. The buffer tank 35 allows for some limited amount of heat storage whenever the load loop draws less fluid than the coil tube heater 30 is circulating.

In operation, oil and air are supplied to the burner assembly 15 to create a flame that is directed toward the ceramic target 17. The heat generated by the creation of the flame is transferred to the fluid within the coil tube cylinder 32 as the exhaust gases are passed along the cylinder 32 four times before being discharged from the furnace 10. The circulators 36, 39 for the heat exchanger system 39 move the system fluid through the cylinder to absorb heat from within the combustion chamber 20 and transport it to a remote location for heating as desired. The aquastat will sense the need for firing of the burner assembly 15, as defined by the temperature of the fluid within the coil tube heater 30, thereby keeping the remote location at the desired temperature.

The buffer tank 35 is sized to provide a heat sink or limited storage mechanism for the heat generated within the furnace 10 and to provide a buffer between the heat demanded from the load loop of the heat exchanger apparatus 39 and the heat generated within the coil tube heater 30. An alternative configuration for instantaneous heat can eliminate the buffer tank 35 if the fill output load of the boiler can be piped to a remote location and the temperature is between 170 and 180 degrees Fahrenheit. Likewise, a larger heat sink could be provided with the elimination of the buffer tank 35, but such a system could not fit beneath the furnace 10 on the frame 11; nevertheless, the coil tube heater 30 can be adapted to provide heat to such a system as well.

Figure 14:
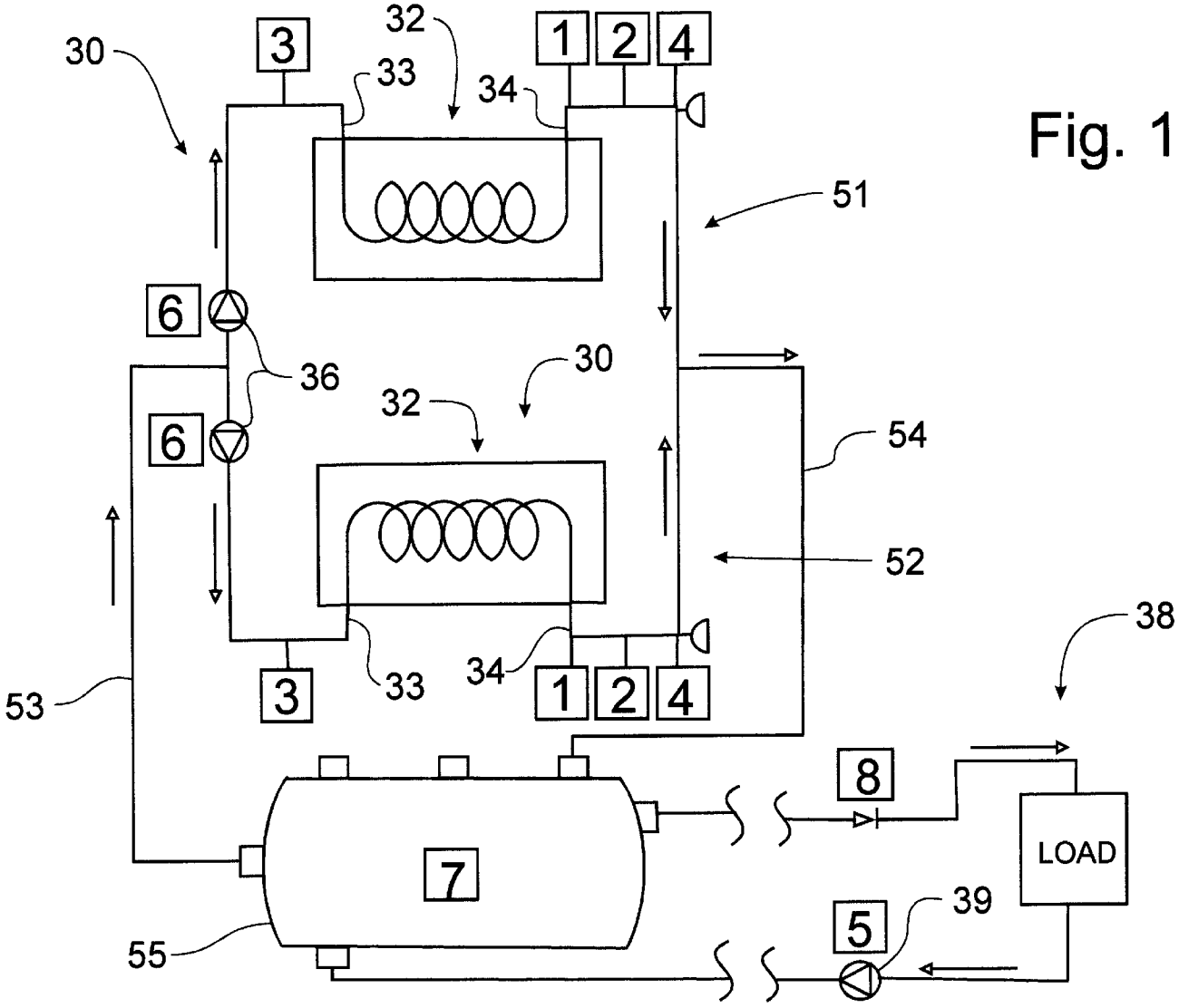
FIG. 14 is a water flow diagram depicting the flow of fluid through the used-oil fired furnace configuration depicted in FIG. 11 to transfer heat from the coil tube heaters to a remote location.
Figure 15:
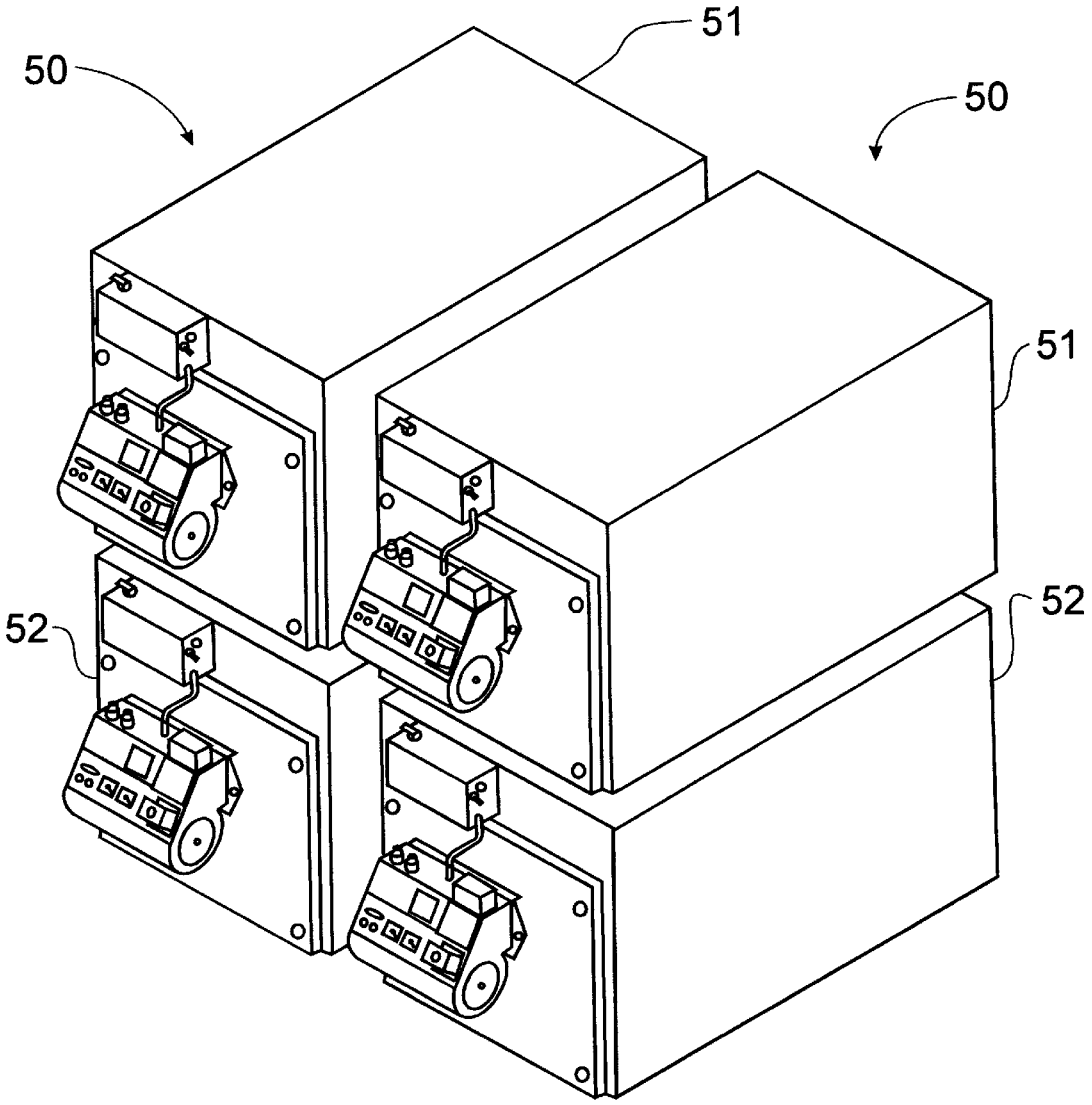
FIG. 15 is an upper, right front perspective view of yet another alternative configuration for the used-oil fired furnace incorporating the principals of the instant invention, wherein a set of four furnaces with coil tube heaters are arranged in a compact stacked orientation.

Referring now to FIGS. 11–15, alternative configurations of used-oil fired furnaces incorporating the principals of the instant invention can best be seen. This specific configurations are particularly intended for use in operations such as car washes. In FIGS. 11–14, the orientation is for a pair of furnaces with coil tube heaters to be stacked vertically so as to have the same footprint as the configuration shown in FIGS. 1–10, yet have at least twice the capacity. A buffer tank 55 is necessarily located remotely. FIG. 15 depicts a quad furnace configuration, which comprises essentially a doubling of the configuration of FIG. 14.

The furnace configuration 50 includes an upper furnace 51 and a lower furnace 52, each of which is equipped with a coil tube heater 30, except that, due to the furnaces 51, 52 being vertically stacked, are arranged to exit the respective cabinets 12 through a side wall, rather than the top wall. Otherwise, the construction and details of the individual furnaces 51, 52 are substantially identical to that described above with respect to furnace 10. The buffer tank 55, however, is preferably larger than the size intended for the furnace 10, as the use of this configuration for operations such as a car wash requires a larger heat sink to maintain hot water flows during peak usage.

As for the water flow diagram of FIG. 14, the coil tube heaters 30 of the upper and lower furnaces 51, 52 are coupled at the inlet and outlet lines 33, 34 to convey heated water to a single buffer tank 55 from which the load loop 38 draws heated water as needed. Each of the upper and lower furnaces 51, 52 are preferably provided with individual circulators 36 so that proper flow through the individual coil tube heaters 30 can be maintained. Clearly, the combined inlet and outlet lines 53, 54 between the buffer tank 55 and the combined upper and lower furnaces 51, 52, must be sized properly to allow for adequate flow through the individual coil tube heaters 30.

It will be understood that changes in the details, materials, steps and arrangements of parts which have been described and illustrated to explain the nature of the invention will occur to and may be made by those skilled in the art upon a reading of this disclosure within the principles and scope of the invention. For example, the coil tube cylinder 32 can be configured in a double coil orientation with one coil oriented inside of the second coil. The foregoing description illustrates the preferred embodiment of the invention; however, concepts, as based upon the description, may be employed in other embodiments without departing from the scope of the invention.

Having thus described the invention, what is claimed is:

1. In a used-oil fired furnace having a cabinet housing a combustion chamber; and a burner assembly operable to project a flame within said combustion chamber, the improvement comprising:

a coil tube heater including a coiled heat exchanger supported within said combustion chamber and being oriented such that said flame is projected with said coiled heat exchanger extending circumferentially around said flame, said coil tube heater having a liquid transfer medium circulated therethrough to transfer heat generated by said flame to a location remote from said cabinet, said coiled heat exchanger is formed from tubing coiled into a plurality of loops positioned adjacent one another, none of said loops being connected to any of said loops adjacent thereto, said coiled heat exchanger having an inlet line and an outlet line connected thereto for the circulation of said liquid transfer medium through said coiled heat exchanger.

2. The used-oil fired furnace of claim 1 wherein said coiled heat exchanger is supported on a generally semi-circular support member having support legs engaging walls of the combustion chamber.

3. The used-oil fired furnace of claim 2 wherein said support member also includes opposing divider flanges extending outwardly from said support member to engage the walls of said combustion chamber, thereby generally vertically dividing a forward portion of said combustion chamber into upper and lower portions.

4. The used-oil fired furnace of claim 3 wherein said support legs of said support member divide a rearward portion of said combustion chamber into two flow paths, one of said flow paths being defined between said support legs, the second of said flow paths being defined between each said support leg and an adjacent said divider flange, said support legs extending forwardly from a rear wall of said combustion chamber to terminate rearwardly of a front wall of said combustion chamber.

5. The used-oil fired chamber of claim 4 wherein heated exhaust gases created by said flame pass forwardly within said combustion chamber internally of said coiled heat exchanger, then pass rearwardly above said coiled heat exchanger through said upper portion of said combustion chamber, then pass forwardly again through said second flow path in said lower portion of said combustion chamber, and then pass rearwardly again through said first flow path in said lower portion of said burner before exiting through a discharge opening in flow communication with said first flow path.

6. The used-oil fired furnace of claim 1 wherein said coil tube heater is provided with a circulation loop including a first circulator directing a flow of liquid transfer medium through said inlet line, said coiled heat exchanger and said outlet line to extract heat absorbed within said liquid transfer medium while in said coiled heat exchanger to a location remote from said combustion chamber.

7. The used-oil fired furnace of claim 6 wherein said circulation loop includes a buffer tank in flow communication with said inlet and outlet lines to provide a storage sink for heat extracted from said coiled heat exchanger.

8. The used-oil fired furnace of claim 7 wherein said buffer tank is mounted on said furnace beneath said combustion chamber.

9. The used-oil fired furnace of claim 7 wherein said circulation loop is associated with a second load loop having a second circulator and being connected to said outlet line to draw heated liquid transfer medium directly from said coiled heat exchanger to a load cell remote from said furnace, said second load loop being connected to said inlet line to return cooled liquid transfer medium to said circulation loop for re-heating within said coiled heat exchanger.

10. In a used-oil fired furnace having a cabinet housing a combustion chamber; and a burner assembly operable to project a flame within said combustion chamber, the improvement comprising:

a coil tube heater including a coiled heat exchanger supported within said combustion chamber and being oriented such that said flame is projected with said coiled heat exchanger extending circumferentially around said flame, said coil tube heater having a liquid transfer medium circulated therethrough to transfer heat generated by said flame to a location remote from said cabinet; and a ceramic sleeve surrounding said burner assembly and being positioned between said burner assembly and said coil tube heater, said ceramic sleeve being formed from two semi-circular members defining an upper half and a lower half, said lower half being supported on said coiled heat exchanger, said upper half being supported on said lower half.

11. A coil tube heater for a used-oil fired furnace having a cabinet housing a combustion chamber having a burner assembly mounted therein to create a fame within said combustion chamber and generate heat, comprising:

a coiled heat exchanger formed from a single length of tubing coiled into a plurality of loops plurality of loops positioned adjacent one another extending forwardly from a back wall of said combustion chamber, said coiled heat exchanger defining a generally circular cylindrical structure within which said flame is generated by said burner assembly, none of said coiled heat exchanger loops being connected to any of the adjacent said loops to limit expansion of said coiled heat exchanger in a fore-and-aft direction;

a generally semi-circular support member supporting said coiled heat exchanger in an elevated position within said combustion chamber, said support member having spaced apart legs engaging walls of said combustion chamber to support said coiled heat exchanger in said elevated position;

an inlet line connected to a first end of said coiled heat exchanger to introduce a supply of liquid transfer medium into said coiled heat exchanger to absorb heat from exhaust gases created by the generation of said flame;

an outlet line connected to an opposing second end of said coiled heat exchanger to permit said liquid transfer medium to exit said coiled heat exchanger after absorbing heat from said combustion chamber, said inlet and outlet lines being part of a circulation loop including a first circulator to extract heat from said combustion chamber to a location remote from said cabinet.

12. The coil tube heater of claim 11 wherein said support member is further provided with a pair of opposing divider flanges extending outwardly from said support member to engage side walls of said combustion chamber and thereby generally vertically divide a forward portion of said combustion chamber into upper and lower portions, said flanges and said legs defining a first flow path between said legs and a second flow path between said flanges and said legs within the lower portion of said combustion chamber to provide multiple passes of exhaust gases created by said flame across said coiled heat exchanger.

13. The coil tube heater of claim 12 wherein said circulation loop is in flow communication with a second load circulation loop including a second circulator operable to draw heated liquid transfer medium from said outline line to a load cell to extract heat from said liquid transfer medium and then to said inlet line to re-introduce the cooled liquid transfer medium into said coiled heat exchanger.

14. The coil tube heater of claim 13 wherein said circulation loop includes a buffer tank located externally of said cabinet to provide storage of said heated liquid transfer medium externally of said cabinet.

15. The coil tube heater of claim 14 wherein said exhaust gases created by said flame pass forwardly within said combustion chamber internally of said coiled heat exchanger, then pass rearwardly above said coiled heat exchanger through said upper portion of said combustion chamber, then pass forwardly again through said second flow path in said lower portion of said combustion chamber, and then pass rearwardly again through said first flow path in said lower portion of said burner before exiting through a discharge opening in flow communication with said first flow path.

16. The coil tube heater of claim 15 wherein said combustion chamber is provided with a ceramic sleeve surrounding said burner assembly and being positioned between said burner assembly and said coil tube heater, said ceramic sleeve being formed from two semi-circular members defining an upper half and a lower half, said lower half being supported on said coiled heat exchanger, said upper half being supported on said lower half.

* * * * *